United States Patent [19]

Lauf

[11] Patent Number: 4,510,112

[45] Date of Patent: Apr. 9, 1985

[54] PROCESS FOR FABRICATING ZNO-BASED VARISTORS

[75] Inventor: Robert J. Lauf, Oak Ridge, Tenn.

[73] Assignee: The United States of America as represented by the United States Department of Energy, Washington, D.C.

[21] Appl. No.: 459,922

[22] Filed: Jan. 21, 1983

[51] Int. Cl.[3] ..... H01B 1/08

[52] U.S. Cl. ..... 264/234; 264/332; 264/345

[58] Field of Search ..... 264/61, 65, 66, 332, 264/345, 234; 501/103

[56] References Cited

U.S. PATENT DOCUMENTS

| | | | |
|---|---|---|---|
| 3,955,168 | 5/1976 | Levinson | 338/21 |
| 4,046,847 | 9/1977 | Kresge | 264/61 |
| 4,052,340 | 10/1977 | Eijnthoven | 264/65 |
| 4,165,351 | 8/1979 | Moy | 264/61 |
| 4,180,483 | 12/1979 | Ho | 264/332 |
| 4,219,518 | 8/1980 | Philipp | 264/66 |
| 4,243,622 | 1/1981 | Kresge | 264/66 |
| 4,338,223 | 7/1982 | Yokomizo | 264/61 |
| 4,349,496 | 9/1982 | Levinson | 264/61 |

OTHER PUBLICATIONS

Snow, "Hot Press With Flat Plate Heaters and Its Application to the Fabrication of Large Varistor Slugs", *Am. Cer. Soc. Bull.*, May 1980, pp. 550–551.

Snow, "Characterization of High Field Varistors in the System ZnO–CoO–PbO–$Bi_2O_3$", *Am. Cer. Soc. Bull.*, Jun. 1980, pp. 617–622.

*Primary Examiner*—John A. Parrish

*Attorney, Agent, or Firm*—Fred O. Lewis; Stephen D. Hamel

[57] ABSTRACT

The invention is a process for producing ZnO-based varistors incorporating a metal oxide dopant. In one form, the invention comprises providing a varistor powder mix of colloidal particles of ZnO and metal-oxide dopants including $Bi_2O_3$. The mix is hot-pressed to form a compact at temperatures below 850° C. and under conditions effecting reduction of the ZnO to sub-stoichiometric oxide. This promotes densification while restricting liquid formation and grain growth. The compact then is heated under conditions restoring the zinc oxide to stoichiometric composition, thus improving the varistor properties of the compact. The process produces fine-grain varistors characterized by a high actual breakdown voltage and a high average breakdown voltage per individual grain boundary.

8 Claims, 1 Drawing Figure

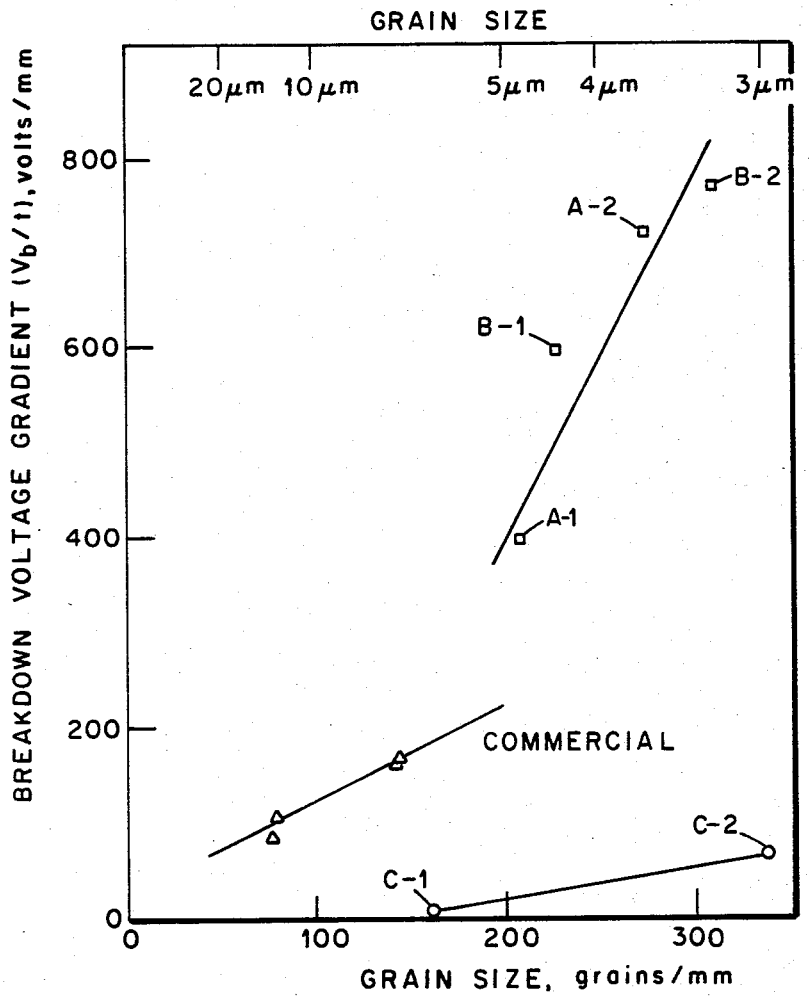
GRAIN SIZE
20μm
10μm
5μm
4μm
3μm
BREAKDOWN VOLTAGE GRADIENT ($V_b$/t), volts/mm
800
600
400
200
0
A-2
B-2
B-1
A-1
COMMERCIAL
C-2
C-1
0
100
200
300
GRAIN SIZE, grains/mm

PROCESS FOR FABRICATING ZNO-BASED VARISTORS

BACKGROUND OF THE INVENTION

This invention relates generally to processes for the production of metal-oxide varistors and more particularly, zinc-oxide-based varistors incorporating at least one metal oxide as a dopant. The invention is a result of a contract with the United States Department of Energy.

Zinc-oxide-based varistors are ceramics whose highly nonlinear electrical-conduction characteristics make them suitable for use as surge arrestors or voltage limitors in electrical systems. Non-ohmic behavior in zinc oxide (ZnO) is achieved by doping with one or more oxides, such as those of bismuth, antimony, cobalt, and rare earths. Doping results in the formation of voltage barriers at the grain boundaries. The increase in the varistor conductivity is related to temporary breakdown of the grain-boundary barriers; thus, the varistor breakdown voltage ($V_b$) is inversely related to the average ZnO grain size.

Commercial processes for the production of ZnO-based varistors involve sintering mixtures of the ZnO and dopant powders in air or vacuum at 1200° to 1400° C. The typical ZnO-based varistor includes $Bi_2O_3$ as a dopant. Unfortunately, the ZnO—$Bi_2O_3$ system has a eutectic at 750° C., with the result that appreciable liquid formation and grain growth occur during sintering. Consequently, varistors designed for high voltage applications (e.g., lightning arrestors for electrical-transmission systems at $10^6$ volts) are undesirably large.

The previous art includes the following article, describing an experiment conducted to demonstrate the desirability of using a flatplate heater press to produce ceramic slugs with a large aspect ratio: "Hot Press With Flat Plate Heaters and Its Application To The Fabrication Of Large Varistor Slugs", *American Ceramic Society Bulletin,* Vol. 59, No. 5, May 1980. In that experiment, densification was accomplished in an oxygen-containing atmosphere. That is, a cold-pressed compact was mounted in a hot-pressing system; after evacuation of the system, a fixed, low load was applied to the compact while the temperature was gradually increased from ambient. The system then was back-filled with oxygen, following which the temperature was raised appreciably and the load was increased by a factor of about 4.5 to effect densification. The following article describes the fabrication of ZnO-based varistors by a single-step hot-pressing process conducted in air: "Characterization of High Field Varistors in the System ZnO—CoO—PbO—$Bi_2O_3$, " *American Ceramic Society Bulletin,* Vol. 59, No. 6, June 1980.

SUMMARY OF THE INVENTION

Accordingly, it is an object of this invention to provide a novel process for the production of ZnO-based varistors.

It is another object to provide a process for producing ZnO-based varistors characterized by a high actual breakdown voltage and a high average breakdown voltage per individual grain boundary.

In one aspect, the invention is a process for producing a metal-oxide varistor by proving a varistor powder mix which includes ZnO and at least one metal-oxide dopant. A densified compact is formed by hot-pressing the mix under conditions effecting reduction of the ZnO to sub-stoichiometric oxide. The resulting compact then is heated under conditions restoring the sub-stoichiometric oxide to ZnO. In another aspect, the varistor powder mix comprises colloidal particles of ZnO and at least one metal-oxide dopant. The mix is formed into a compact by hot-pressing at a temperature below about 1100° C. under conditions for effecting reduction of the ZnO to sub-stoichiometric zinc oxide. The compact then is heated under conditions effecting restoration of the sub-stoichiometric oxide to ZnO. In another aspect, the varistor powder mix comprises colloidal particles of zinc oxide and metal-oxide dopants including bismuth oxide. The mix is hot-pressed at below about 1100° C. to effect reduction of a compact having a density exceeding about 50% theoretical. The compact then is heated in an oxidizing atmosphere to restore the sub-stoichiometric zinc oxide to stoichiometric oxide, following which the compact is provided with spaced ohmic electrodes.

BRIEF DESCRIPTION OF THE FIGURE

The single FIGURE is a graph comparing commercial varistors and experimental varistors produced in accordance with the invention, the comparison being in terms of breakdown-voltage gradient, average grain size, and grains per millimeter.

DETAILED DESCRIPTION OF THE INVENTION

The invention is directed toward the production of ZnO-based varistors characterized by a relatively small average grain size and a relatively high average breakdown voltage per individual grain boundary. The invention has special application to varistor powder mixes which contain ZnO and a metal-oxide dopant which forms a eutectic therewith. The formation of a eutectic during sintering of the mix is undesirable because the presence of the liquid phase promotes grain growth; for example, the ZnO and $Bi_2O_3$ system has a eutectic temperature at 750° C. To keep liquid formation to a minimum, the invention effects densification of such systems by the technique of hot-pressing in a reducing atmosphere. The reducing atmosphere promotes densification, permitting hot-pressing to be conducted at comparatively low temperatures—e.g., below about 1,100° C., thus decreasing grain growth. It is believed that the reducing atmosphere promotes densification by forming sub-stoichiometric zinc oxide containing many Zn interstitials.

Preferably, the hot-pressing is conducted until the density of the resulting powder compact approaches the theoretical value, or at least until the density exceeds about 50% theoretical. The pressed compact then is heat-treated in an oxygen-containing atmosphere to restore the zinc oxide to the stoichiometric composition and eliminate electronic conductivity. In other words, the heat-treatment (re-oxidation) converts the undesirable electrical properties of the as-pressed compact to the desired non-ohmic (varistor) properties. The re-oxidation operation also improves electrical properties by increasing the valence of any oxide dopants which were reduced during hot-pressing and may also effect some increase in density. Preferably, the varistor powder mix to be hot-pressed is composed of aggregates which consist of colloidal particles of the constituent oxides.

EXAMPLE I

Sol-gel techniques involving precipitation and peptization were used to prepare a batch of highly active powder designated herein as Powder A and having the composition given below.

| Powder A: Nominal Composition (mole %) | | | | | |
|---|---|---|---|---|---|
| $Bi_2O_3$ | $Sb_2O_3$ | CoO | $Cr_2O_3$ | MnO | ZnO |
| 0.5 | 1.0 | 0.5 | 0.5 | 0.5 | Balance |

Powder A was prepared by separately precipitating each of the above-listed constituents as a hydrous oxide from aqueous solution, using $NH_4OH$. Each of the resulting precipitates was washed thoroughly to remove ammonium salts, using gravity settling and decantation. The washed hydrous oxides were combined, and the resulting mixture was shaken at high speed to form an unstable sol. This in turn was evaporated and dried in an oven at 110°0 C. to form a gel. Residual water was removed from the gel by calcining at 250° C. in air for 1 hour. The resulting calcined powder consisted of aggregates composed of colloidal particles of the above-listed oxides; The average particle size was 0.5 μm.

Two samples of the calcined Powder A were hot-pressed in accordance with the invention to form densified compacts. Referring to Table I, the first sample (A-1) was hot-pressed in a reducing atmosphere at 700° C. to form a densified disc (diameter, 16 mm; thickness ~1 mm) having a density of about 50% theoretical. (Hot-pressing was conducted in a graphite die; oxygen for the sample formed CO with the carbon, providing a reducing atmosphere.) As shown in the table, the as-pressed disc was tan in color; tests showed it to be a linear resistor.

In accordance with the invention, hot-pressed Sample A-1 was oxidized in a pressureless operation comprising heating in air at 700° C. for 1 hour. As shown in Table I, this treatment effected a color change to dark green and converted the disc to a nonlinear resistor (R $37\times10^6\Omega$). The sample then was re-heated in air, this time at 1000° C. for 1 hour. The resulting disc was dark green and was characterized by an average grain size of 4.9 μm, corresponding to 208 grains per mm. Grain size was determined by optical metallography. The faces of the discs were provided with copper electrodes, which were affixed with a gallium-indium-tin eutectic, providing ohmic contact. The voltage-current characteristics of the disc were measured by means of a circuit including a dc voltage supply and a microammeter, connected to the varistor electrodes. The applied voltage was increased gradually until breakdown occurred and then was further increased until the current reached 50 to 75 μamps. Breakdown was arbitrarily defined as the point where the current reached 1.5 μamps. The breakdown point was fairly low when the voltage was first applied; after the voltage was increased to higher values the current decreased, $V_b$ was much higher (see Table I) and the voltage-current curve was more reproducible and stable with time. Good electrical properties were obtained. As shown, The breakdown voltage for varistor A-1 after oxidation at 1000° C. was approximately 450 volts. When normalized with respect to sample thickness, the breakdown voltage was about 398 volts/mm.

As shown in Table I, the second sample, A-2, of Powder A was hot-pressed at 800° C. to 99% theoretical density. Oxidation at 700° C. for 2 hours effected a color change from black to dark green; no current flow was measured at up to 1200 volts. As shown, further oxidation at 1000° C. produced a varistor with very good electrical properties. The resulting microstructure consisted of small (approximately 3.6 μm) equiaxed grains having a small amount of porosity.

EXAMPLE II

A second batch of highly active powder having the same nominal composition as Powder A was prepared by sol-gel techniques involving precipitation and peptization. This second batch of powder (Powder B) was prepared in a somewhat different manner from Powder A to enhance intimate mixing and thus uniformity of the production powder. Whereas Powder A was prepared by individually precipitating the hydrous oxides and then combining them to form a sol, Powder B was prepared by peptizing the individually precipitated hydrous oxides to form individual sols and then combining the sols. To effect more rapid liquid-solid separation and thus less aggregation, the individual hydrous oxides were washed in a centrifuge. This mode of washing appeared to give more gelatinous hydrous oxides with less tendency to grow more crystals. As in Example I, the gel was dried at 110° C. and calcined at 250° C. The calcined powder consisted of aggregates consisting of colloidal particles of the oxides constituents.

Two samples, B-1 and B-2, of Powder B were processed in accordance with the invention. As shown in Table I, the resulting varistors were characterized by small grain size and very good electrical properties, such as high breakdown voltages normalized for varistor thickness.

EXAMPLE III

A third batch of powder (Powder C) was prepared by co-precipitation techniques. This powder had the following composition.

| Nominal Composition (mole %) | |
|---|---|
| $Bi_2O_3$ | ZnO |
| 1.5 | Balance |

Powder C was prepared by dissolving 50 g of $ZnCl_2$ and 1.9 g of $Bi_5O(OH)_9(NO_3)_4$ in distilled water. This solution was combined with a large excess of $NH_4OH$ to co-precipitate the zinc and bismuth as hydroxides. The resulting powder was washed several times and dried in air at 100° C. The powder then was calcined at 500° C.

As shown in Table I, a sample (C-1) of the powder was processed in accordance with the invention. The hot-pressed disc was first oxidized at 700° C. and subsequently at 1000° C. Relatively small grain sizes were obtained, but breakdown voltages were low. The lower quality is believed to be due to (a) the use of only two components in the powder mix and (b) the use of co-precipitation techniques, which normally do not produce powders as active as sol-gel powders. Compared with the above-described varistors prepared with sol-gel powders, the C-1 varistor had a broader size distribution of the ZnO grains and a less homogenous Bi distribution.

TABLE 1

| Sample | Hot-Pressing* Temperature | Heat-Treatment** Temperature | Color | Type of Resistor | Av. Grain Size (μm) | Grains/ mm | $V_b$ (volts) | $V_b$/t (volts/ mm) |
|---|---|---|---|---|---|---|---|---|
| A-1 | 700° C. | As-pressed | tan | L | | | | |
| | As-pressed | 700° C.-1 hr | dk green | NL | | | | |
| | density, 50% | 1000° C.-1 hr | dk green | NL | 4.8 | 208 | approx. 450 | 398 |
| A-2 | 800° C. | As-pressed | black | L | | | | |
| | (As-pressed | 700° C.-2 hr | dk green | No current to 1200 v | | | | |
| | density, 99%) | | | | | | | |
| | | 1000° C.-1 hr | dk green | NL | 3.6 | 275 | approx. 950 | 720 |
| B-1 | 750° C. | As-pressed | gray | L | | | | |
| | (As-pressed | 1000° C.-1 hr | dk green | NL | 4.0 | 228 | approx. 1000 | 596 |
| | density, 60%) | | | | | | | |
| B-2 | 800° C. | As-pressed | dk green | L | | | | |
| | | 1000° C.-1 hr | dk green | NL | 3.2 | 310 | approx. 1130 | 768 |
| C-1 | 690° C. | As-pressed | gray | L | | | | |
| | (As-pressed | 700° C.-2 hr | lt yellow | NL | approx. 3 | 335 | approx. 140 | 67 |
| | density 91%) | 1000° C.-1 hr | yellow | NL | 6.2 | 160 | approx. 25 | 9 |

*All in vacuum at 9000 psi for 15 min in graphite die, except B2 hot-pressed for 5 min
**All heat-treatments in air At 1.5 μamps
L: Linear
NL: Non-linear Table II compares the above-described experimental varistors with four commercial varistors having nominal breakdown voltages of 130 to 510 volts. The table compares average grain size, grains per millimeter, actual breakdown voltage, and the breakdown voltage normalized for varistor thickness. The relatively fine-grained experimental multicomponent varistors (the A and B samples) have larger breakdown voltages than would be predicted on the basis of grain size alone. In contrast to the experimental varistors, the commercial varistors were prepared by mixing oxide powders in a ball mill, pressing, and then sintering in air at high temperatures.

TABLE II

| Varistor | Average Grain Size, μm | Grains/mm | $V_b$, volts* | $V_b/t$, volts/mm |
|---|---|---|---|---|
| GE 130 V | 12.8 | 78 | 150 | 86 |
| GE 250 V | 12.2 | 82 | 250 | 109 |
| GE 420 V | 7.0 | 143 | 420 | 163 |
| GE 510 V | 6.9 | 145 | 520 | 168 |
| A-1 1000 HT | 4.8 | 203 | 450 | 398 |
| A-2 1000 HT | 3.6 | 275 | 950 | 720 |
| B-1 1000 HT | 4.0 | 228 | 1000 | 596 |
| B-2 1000 HT | 3.2 | 310 | 1130 | 768 |
| C-1 700 HT | approx. 3 | 335 | approx. 140 | approx. 67 |
| C-1 1000 HT | 6.2 | 162 | 25 | 9 |

*at 1.5 μamps

The single FIGURE is a graphical comparison of the experimental varistors and the commercial varistors with respect to normalized breakdown voltage, grain size, and grains per millimeter. The steep slope for the multi-component varistors (A and B samples) indicates that still larger gains with respect to voltage breakdown may be obtained with a further reduction in grain size. The slope of each curve shown in the FIGURE was analyzed to obtain the corresponding average breakdown potential per individual grain boundary ($V_b$/g.b.) The $V_b$/g.b. values were as follows: commercial varistors, approximately 1.2; experimental multi-component varistors, approximately 2.5; experimental two-component varistors, approximately 0.1.

Referring to the invention more generally, it is preferable to form the varistors from highly active powders consisting of aggregates composed of colloidal particles. Powders prepared by sol-gel techniques are especially suitable. As mentioned, the hot-pressing operation is directed toward achieving densification of the powder mixture at comparatively low temperatures, so as to restrict the formation of a liquid phase. The hot-pressing is conducted to achieve a densification of at least about 50% of the theoretical value, and preferably above 90%. To promote densification, the hot-pressing is conducted under conditions effecting reduction of the ZnO to sub-stoichiometric oxide. More specifically, the hot-pressing may be conducted in a reducing atmosphere at a temperature in the range of about 600° C. to about 1100° C.; preferably, the maximum temperature is below about 850° C. The heat-treatment (re-oxidation) operation is conducted in an oxygen-containing atmosphere under conditions restoring the ZnO to its stoichiometric composition and may effect additional densification. Too high a temperature in this operation tends to promote grain growth, whereas too low a temperature may leave some of the ZnO in the sub-stoichiometric state, resulting in electronic conductivity and poor non-ohmic behavior.

The foregoing description of the invention has been provided for the purpose of illustration and to enable others skilled in the art to utilize the invention in various forms suited to the contemplated use. The description is not intended to be exhaustive and various modifications will be evident to persons skilled in the art. Given the teachings herein, such persons will be able to determine the most suitable process parameters for a given application without resorting to more than routine experimentation. It is intended that the scope of the invention be defined by the appended claims.

What is claimed is:

1. A process for producing a metal-oxide varistor, comprising:

providing a varistor sol-gel powder mix including ZnO and at least one metal-oxide dopant, forming a densified compact of said mix by hot-pressing the same until the density of said compact exceeds about 50% of theoretical in a reducing atmosphere so as to reduce said ZnO to sub-stoichiometric zinc oxide, and heating the resulting compact in an oxidizing atmosphere so as to effect restoration of said sub-stoichiometric oxide to stoichiometric ZnO.

2. The process of claim 1 wherein said hot-pressing is conducted at a temperature below about 1,100° C.

3. The process of claim 1 wherein said hot-pressing is conducted in vacuum and in the presence of carbon.

4. The process of claim 3 wherein said hot-pressing is conducted at a temperature below about 850° C.

5. A process for producing a metal-oxide varistor, comprising:

providing a varistor sol-gel powder mix of colloidal particles of ZnO and at least one metal-oxide dopant;

forming a compact of said mix by hot-pressing the same at a temperature below about 1100° C. in a reducing atmosphere so as to reduce said ZnO to sub-stoichiometric zinc oxide, and heating said compact in an oxidizing atmosphere so as to restore said sub-stoichiometric oxide to stoichiometric ZnO.

6. The process of claim 5 wherein said hot-pressing is conducted at a temperature below about 850° C.

7. A process for producing a metal-oxide varistor, comprising:

providing a varistor powder mix by calcining a gel comprising zinc-oxide and metal-oxide dopants including bismuth oxide, hot-pressing said mix at a temperature below about 1100° C. in a reducing atmosphere so as to reduce the zinc oxide to sub-stoichiometric oxide and formation of a powder compact having a density exceeding about 50% of the theoretical value, heating said compact in an oxidizing atmosphere to restore the sub-stoichiometric zinc oxide to stoichiometric zinc oxide, and providing the resulting compact with space ohmic electrodes.

8. The process of claim 7 wherein said hot-pressing is conducted at a temperature below about 850° C.

* * * * *